US005350016A

United States Patent [19]

Thornton, Jr.

[11] Patent Number: 5,350,016

[45] Date of Patent: Sep. 27, 1994

[54] WELLBORE ANCHOR

[75] Inventor: Willie H. Thornton, Jr., Fort Worth, Tex.

[73] Assignee: Atlantic Richfield Company, Los Angeles, Calif.

[21] Appl. No.: 109,894

[22] Filed: Aug. 23, 1993

[51] Int. Cl.[5] ..... E21B 23/04

[52] U.S. Cl. ..... 166/120; 166/206

[58] Field of Search ..... 166/206, 209, 210, 216, 166/124, 123, 139, 217

[56] References Cited

U.S. PATENT DOCUMENTS

| | | | |
|---|---|---|---|
| 2,068,659 | 1/1937 | Crickmer | 166/210 |
| 2,869,644 | 1/1959 | Brown | 166/209 |
| 3,135,327 | 6/1964 | Hanes | 166/120 |
| 3,142,338 | 7/1964 | Brown | 166/120 |
| 3,399,729 | 9/1968 | McGill | 166/120 |
| 3,623,551 | 11/1971 | Randermann, Jr. | 166/134 |
| 3,714,983 | 2/1973 | Wilson | 166/120 |
| 5,024,270 | 6/1991 | Bostick | 166/120 X |

*Primary Examiner*—Michael Powell Buiz
*Assistant Examiner*—Frank S. Tsay
*Attorney, Agent, or Firm*—Roderick W. MacDonald

[57] ABSTRACT

A wellbore anchor tool employing at least one pair of individual slip segments which wrap at least partially around a mandrel passing through the tool, the individual slip segments carrying bearing surfaces and restraint members for holding the slip segments in the tool but at the same time in slidable engagement with the tool.

30 Claims, 4 Drawing Sheets

WELLBORE ANCHOR

BACKGROUND OF THE INVENTION

Heretofore, wellbore anchors have been employed in practice using full circle segmented slips which, when acted upon by a suitable drive member, fragment into a plurality of individual slip parts. Full circle (one piece) segmented slip tools work well when the interior diameter of the pipe or casing in which the tool is to be set is uniform. For example, when the wellbore pipe from the earth's surface to the point where the tool is to be set is 5 inch (20.3 pound per foot) casing the inside diameter is 4.184 inches. After fragmenting the full circle slip inside this 5 inch pipe, the slip parts need to move laterally towards the pipe from about ⅛ to ¼ inch before they contact and bite into the pipe wall to fix the tool in place at that point.

When the inner diameter of the pipe in the well is not uniform, the full circle segmented slip tool is not as useful. For example, there are situations where there are two pipe strings in the same wellbore, one pipe string being of a smaller diameter than the other and concentric in the interior of the larger diameter pipe, and the smaller diameter pipe terminates somewhere along the length of the larger diameter pipe. In such a situation if the smaller diameter pipe is not removed from the well, a costly procedure, the wellbore tools have to first pass through the smaller diameter pipe and then after they leave the bottom end of the smaller diameter pipe, work within the larger area provided by the larger diameter pipe. The limited ¼ inch lateral movement for the foregoing full circle segmented slip is inadequate for setting such a tool in the larger diameter pipe below the point where the small diameter pipe terminates. For example, if the foregoing 5 inch pipe was the smaller pipe and was set inside 7 inch (29 pound per foot) casing as the larger pipe, the 7 inch casing would have a 6.184 inch inside diameter. In such a case, the well tool would have to pass through the 4.184 inch inside diameter of the 5 inch pipe until it reached the end of that pipe and entered into the area where only the 7 inch pipe was present. In 7 inch pipe the tool would have to move its slips approximately 1¼ inches laterally before the slips would engage the 7 inch pipe. Regular full circle segmented slips are just not capable of this magnitude of lateral movement.

SUMMARY OF THE INVENTION

By this invention, there is provided a wellbore anchor tool employing unique individual slip segments which segments have a capability of long lateral slip movements, such as the 1¼ inches described hereinabove, so that the tool is readily useful in a wellbore where the inside pipe diameter is not uniform.

In accordance with this invention, individual slip segments are employed which have the standard slip wickers which bite into the inner wall of the pipe facing out from the tool, each slip segment having on its side opposing the wicker side a cavity which allows a slip segment to wrap around an elongate inner member. The cavity side of the slip segment also has a slanted bearing surface and at least one retaining member for holding the slip segment in the tool and in slidable engagement with the tool.

The wellbore anchor tool of this invention employs at least one pair of the foregoing individual slip segments together with a drive member which mates with the sloping bearing surface of each individual slip segment to move the slip segment laterally while maintaining the slip segment's slidable engagement with the tool.

Accordingly, by combination of the wraparound individual slip segment feature with the retaining member and slanted or sloping drive surface features, a wellbore anchor tool is provided which can, for example, readily pass through 4.184 inch inside diameter pipe and then operate within 6.184 inch inside diameter pipe by allowing the individual slip segment to move laterally away from the tool at least 1¼ inches to engage the pipe while still being retained in engagement with the tool.

DETAILED DESCRIPTION

Figure 1:
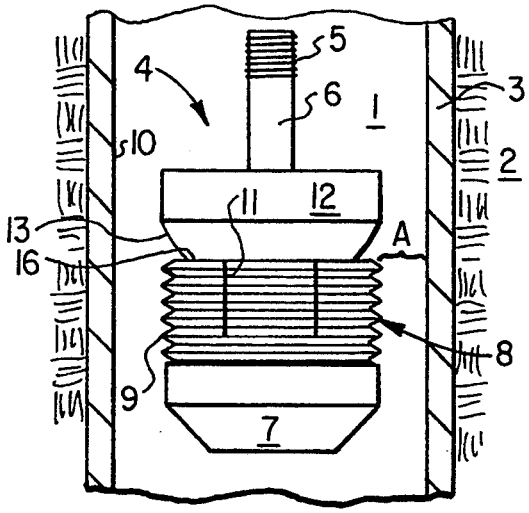
FIG. 1 (PRIOR ART)
FIG. 1 shows a regular full circle segmented slip bridge plug in use in a uniform diameter wellbore pipe.

FIG. 1 shows a wellbore 1 in the earth 2 which is lined by casing or pipe string 3. A conventional bridge plug 4 is shown in the interior of pipe 3 which has been lowered to the position shown by conventional tubing or pipe (not shown) that is connected to the upper threaded portion 5 of mandrel 6. Mandrel 6 has fixed to its lower end shoe 7. Shoe 7 carries a regular, full circle, one piece segmented slip 8. One piece slip 8 carries a plurality of wickers 9 which face towards the inner surface 10 of pipe 3. A plurality of grooves or slots 11 are cut partway through the length of slip 8 to provide weakened zones so that slip 8 will fragment into a plurality of slip parts when engaged by drive member 12.

Figure 2:
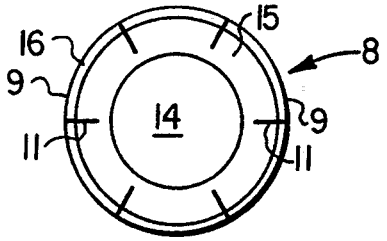
FIG. 2 (PRIOR ART)
FIG. 2 shows a top view of the full circle segmented slip used in FIG. 1.

Engaging surfaces 13 of drive member 12 are curved to mate with a curved inner wall, shown in FIG. 2, in the interior of slip 8.

FIG. 2 shows slip 8 from a top view and further shows that slip 8 is one-piece, circular, and has an open bottom 14 and an inner curved wall or surface 15 which extends roughly from top 16 to open bottom 14. Curved wall 15 mates with the curvature of engagement surface 13 of drive member 12.

Figure 3:
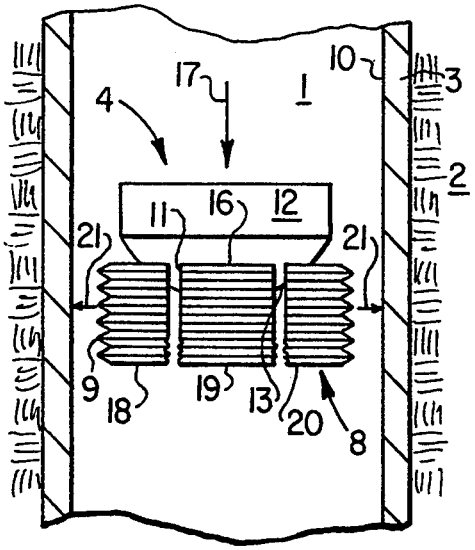
FIG. 3 (PRIOR ART)
FIG. 3 shows the full circle segmented slip of FIGS. 1 and 2 after it is broken into a plurality of individual slip parts inside the pipe of FIG. 1.

FIG. 3 shows full circle slip 8 after drive member 12 has been forced downwardly as shown by arrow 17 to cause slip 8 to break into a plurality of slip parts 18 through 20 to force the slip parts towards pipe 3 as shown by arrows 21. Thus, as mentioned before, if pipe 3 were 4.184 inch inner diameter pipe, slip parts 18 through 20 would have to move laterally in the direction of arrows 21 distance A of about ¼ inch before wickers 9 contacted inner surface 10 of pipe 3. Wickers 9 then bite into pipe 3 sufficiently to hold bridge plug 4 in place at that particular location along the vertical length of pipe 3.

Figure 4:
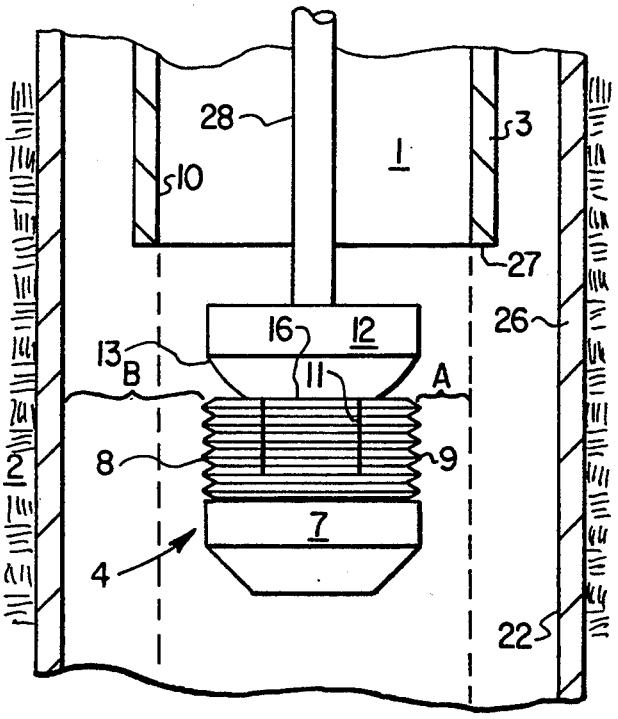
FIG. 4 (PRIOR ART)
FIG. 4 shows the prior art bridge plug of FIG. 1 in a well where the pipe diameter within the well is not uniform.

FIG. 4 shows a situation wherein the pipe in wellbore 1 is not of uniform diameter contrary to the situation of FIGS. 1 through 3 wherein pipe 3 is the only pipe in wellbore 1 for the full length of that wellbore. In the situation of FIG. 4, pipe 3 is concentric within larger diameter pipe 26 and pipe 3 terminates intermediate the length of pipe 26 so that lower end 27 of pipe 3 is, for example, halfway down the vertical length (depth) of wellbore 1. Accordingly, a substantial length of wellbore 1 and pipe 26 extend below terminating end 27 of pipe 3. This way a tool sees the 4.184 inch inner diameter of pipe 3 for a considerable distance but then after passing end 27, the tool sees much larger pipe 26 only. For example, if pipe 26 were 7 inch casing (29 pounds per foot), the tool would see a 6.184 inch inner diameter below end 27 and would have to be able to work within this much larger diameter. In the case of conventional bridge plug 4, instead of having to move slip parts 18 through 20 distance A of about ¼ inch, they would have to move laterally a distance B of about 1¼ inches in order to engage the inner surface 22 of pipe 26. The segment parts from a full circle segmented slip cannot do so without losing engagement with tool 4 and falling downwardly to the bottom of the wellbore because in order to move large distance B, a slip of the configuration of FIG. 2 must move a distance so great that slip parts 18 through 20 lose physical contact with shoe 7. Accordingly, all slidable engagement of slip parts 18 through 20 with tool 4 is lost and unrestrained parts 18 through 20 become useless debris at the bottom of the wellbore rather than serving as an integral part of bridge plug 4. This is why conventional full circle segmented slip tools are not readily operable in wells whose pipe diameter is not uniform.

FIG. 4 shows that tool 4 is lowered through pipe 3 and 26 by way of tubing 28 which can be conventional jointed straight pipe or coiled tubing, either of which extends to the operating rig at the earth's surface (not shown).

The tool of this invention can operate through distance A in smaller diameter pipe 3 or can pass through pipe 3 and operate just as well through distance B in larger pipe 26 below end point 27 of pipe 3. This is accomplished with the unique individual slip segments of this invention without losing supporting and slidable engagement with the tool.

Figure 5:
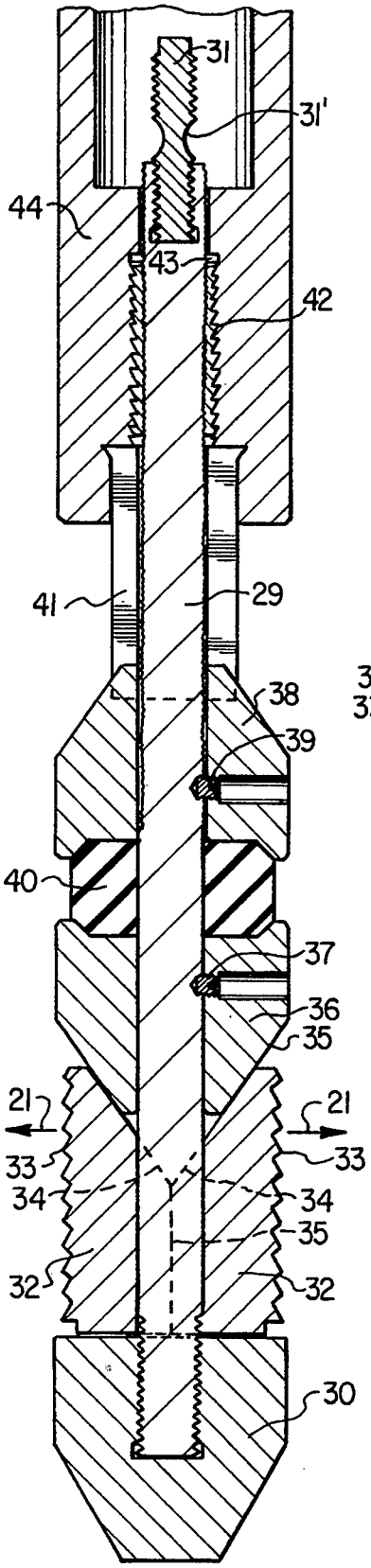
FIG. 5 shows a cross section of one anchor tool within the scope of this invention.

FIG. 5 shows one embodiment of a tool within this invention which employs two pairs of the individual slip segments of this invention. More specifically, a central mandrel 29 carries at its lower end shoe 30 and its upper end shear stud 31. A first lower pair of individual slip segments 32 are mounted about mandrel 29 so that their wickers 33 face away from mandrel 29. As shown by dotted lines 34 and 35 individual slip segment pair 32 wrap around mandrel 29. Sloping drive surface 34 for each individual slip segment 32 provides a drive surface for mating with sloping drive or engagement surface 35 of drive member 36. Drive member 36 is fixed to mandrel 29 by way of shear pin 37. A similar but upwardly oriented drive member 38 is similarly fixed to mandrel 29 by way of shear pin 39. Drive members 36 and 38, which can be a truncated cone in configuration, are separated from one another by resilient member 40. A second pair of individual slip segments are carried about mandrel 29 above drive member 38 as shown at 41 except that slip member pair 41 is rotated 90 degrees with respect to slip segment pair 32.

Figure 7:
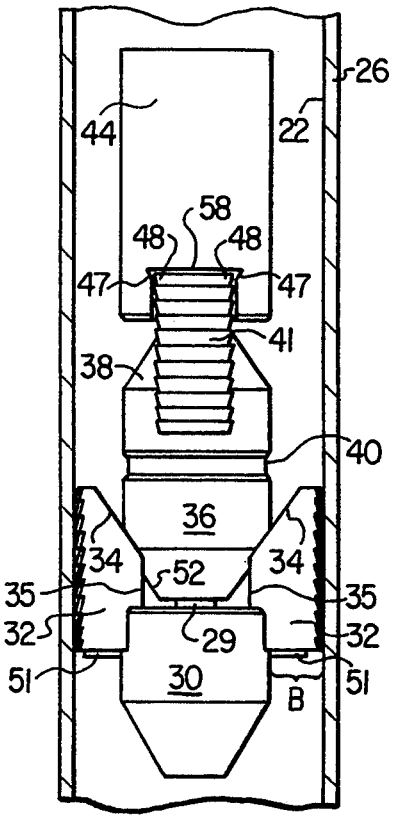
FIG. 7 shows the anchor of FIG. 6 with its individual slip segments activated to their set position in the wellbore pipe.

Above slip segment pair 41 is a conventional lock ring 42 which is carried about mandrel 29 and fixed between slip segment pair 41 and stop 43. Carrying sleeve 44 carries the overall tool, for example, on tubing 28. Shear stud 31 is connected to a separate member on a conventional running tool such as an orienting tool (not shown) so that when member 41 is held in place and the separate member connected to shear stud 31 raised, both mandrel 29 and shoe 30 are pulled upwardly. This forces slip segment pairs 32 and 41 against their respectively adjacent drive cones 36 and 38 to force each individual slip segment laterally as represented by arrow 21 towards the inner surface of the enclosing pipe as shown in FIG. 7. This movement compresses resilient member 40 which then maintains pressure on both drive members 36 and 38 because lock ring 42 prevents drive members 36 and 38 from moving apart again. This in turn locks each individual slip segment into biting engagement with the inner surface of the pipe. The slip segments maintain contact support and slidable engagement with their respective drive members through use of a retaining member as will be described in greater detail hereinafter.

Thus, it can be seen from FIG. 5 that by pulling upwardly on shear stud 31 while holding the tool in place by way of member 44, shear pins 37 and 39 are sheared, at the same time or sequentially as desired, thereby allowing the slip segment pairs to be forced against their adjacent drive members to compress resilient member 40 and drive each individual slip segment laterally, the slip segments being locked in their lateral extension by lock ring 42 which leaves the tool permanently set in engagement with the pipe when shear stud 31 finally severs at necked down portion 31'. When the tool is run into the pipe, the retaining members hold the individual slip segments in the tool but in slidable engagement with the tool so that they can slide laterally substantial distances of at least 1¼ inches without losing engagement with the tool as will be explained hereinafter.

Figure 6:
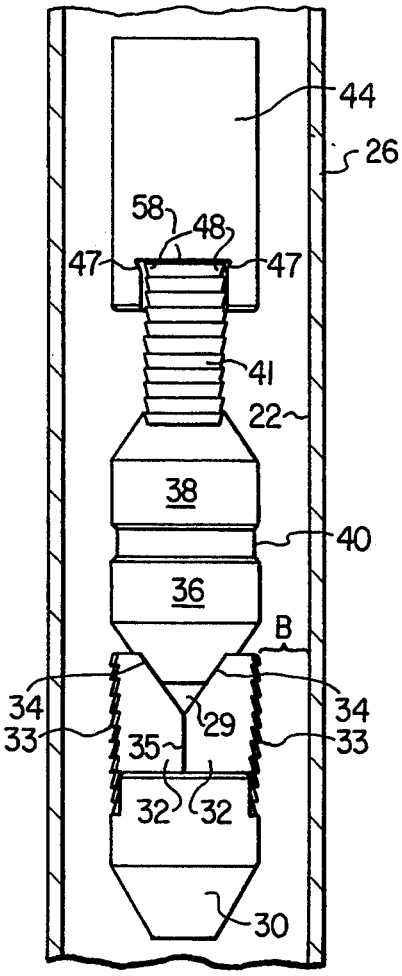
FIG. 6 shows the anchor tool of FIG. 5 when running into the wellbore pipe.

FIG. 6 shows the tool of FIG. 5 in simplified form in the configuration it would be in when it is passed through the interior of smaller diameter pipe 3 of FIG. 4 and after it has passed below lower end 27 of pipe 3 and is ready to be set inside larger diameter pipe 26 as shown for bridge plug 4 in FIG. 4.

FIG. 7 shows the tool of FIG. 6 after it has been activated or otherwise set in position at the desired location in wellbore pipe 26 as described hereinabove with respect to FIG. 5. It can be seen from FIG. 7 that the individual slip segments 32 handily bridge the substantial distance B to inner wall 27 of pipe 26 without losing contact support and slidable engagement with shoe 30 and frusto-conical drive member 36. This is accomplished in part by retaining members 51, similar retaining members (not shown) being employed at the interface edges between drive surface 34 and sloping surface 52 of drive member 36 as will be described hereinafter in greater detail. Thus, it can be seen that each individual slip segment of this invention, by way of at least one retaining member, is held in the tool in the position shown in FIG. 6 but is additionally held in slidable engagement with the tool so that each individual slip segment continues to be held in the tool even after being set in place as shown in FIG. 7.

Figure 8:
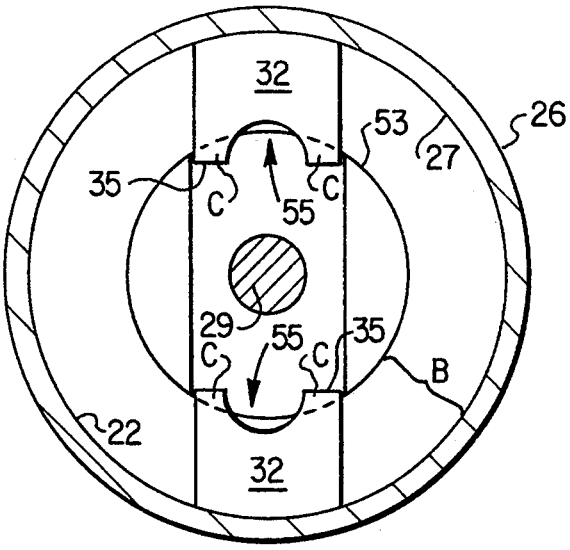
FIG. 8 shows an end view of the tool of FIG. 7.

As mentioned before individual slip segments such as slip segments 32 from FIGS. 5 through 7 wrap around mandrel 29 as shown in FIGS. 5 and 6. FIG. 8 shows a bottom view of individual slip segment pair 32 with shoe 30 removed for clarity but line 53 represents the outer periphery of shoe 30. It can be seen from FIG. 8 that inner surface 35 which is on the side of mandrel 29 and opposes the outer surface which carries wickers 33 (FIG. 6) has a cavity 55 therein which allows the individual slip segments 32 to wrap around mandrel 29 until they meet as shown at 35 in FIG. 6. This wraparound feature gives the individual slip segments sufficient lateral moving distance that they can bridge the considerable distance B (FIG. 7) without disengaging, for example, from shoe 30 or member 36. The portion of each individual slip segment 32 which remains in contact with shoe 30 is designated as area C in FIG. 8.

Thus, it can be seen from FIG. 8 that considerable bearing area C with shoe 30 is maintained notwithstanding the fact that individual slip segments 32 have traversed distance B. Such a result is not possible with a full circle segmented slip such as that shown by slip member 8 of FIGS. 1 through 3.

Figure 9:
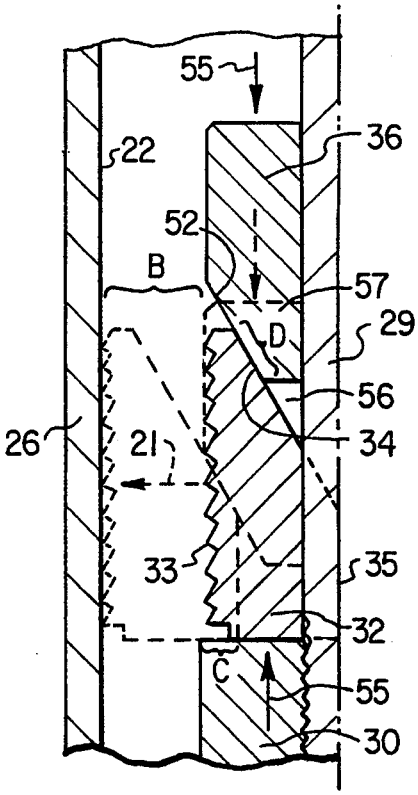
FIG. 9 shows the activation or setting of an individual slip segment pursuant to this invention.

FIG. 9 shows in greater detail the relative interaction between an individual slip segment of this invention, such as slip segment 32, and its adjacent drive member, such as drive member 36. When in the running position shown in FIG. 6, slip segment 32 and drive member 36 are in the position shown by the solid lines. In this configuration, all of the bottom end of slip 32 contacts shoe 30. Slanted surface 34 is a sloping drive surface which contacts at area D a mating slanting drive or engagement surface 52 on drive member 36. When the tool is activated to set it in the pipe as shown in FIG. 7, slip segment 32 and drive member 36 are forced together as represented by arrows 55 so that drive member 36 moves down to the position shown by the dotted lines while individual slip segment 32 moves laterally as represented by phantom arrow 21, until wickers 33 bite into inner wall 22 of pipe 26 as shown by the dotted lines in FIG. 9. When individual slip segment 32 is set as shown by the dotted lines, area C represents the area of continuing supporting contact between shoe 30 and slip segment 32 as shown in FIG. 8.

It can be seen in FIG. 9 that sloped drive surface 34 of individual slip segment 32 angles away from mandrel 29 thereby providing a drive opening 56 which the lower portion 57 of drive member 36 can enter to contact sloping drive surface 34 in area D. It is preferable that sloping drive surface 34 be essentially flat in order to achieve the largest amount of bearing surface available between drive member 36 and individual slip segment 32.

One very distinct advantage for this invention is that if sufficient bearing surface is achieved for area C, bearing surface D will automatically be sufficient because it is always greater than bearing surface C.

It is also clear now that with the wraparound feature of this invention, not only can very large lateral setting distances B be achieved, but at the same time substantial support, i.e., load bearing, surfaces D and C at both ends of each individual slip segment is maintained. Thus, even though each individual slip segment moves a substantial distance B of at least $1\frac{1}{4}$ inches, it is still held in supporting contact with the tool by way of the drive member and shoe and in slidable engagement with the tool by way of one or more retaining members.

Figure 10:
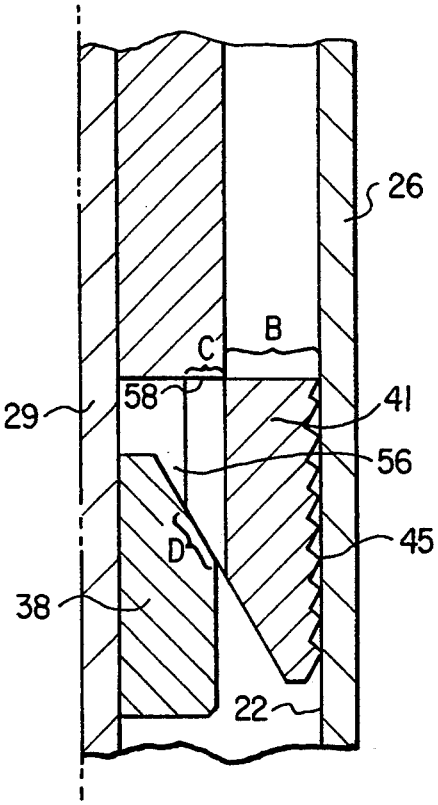
FIG. 10 shows the activation or setting of a different individual slip segment but still within the scope of this invention.

The retention of individual slip segments in the tool but in slidable engagement with the tool is even more important when the relationship of the individual slip segment and the drive member of FIG. 9 is reversed as shown in FIG. 10.

FIG. 10 shows individual slip segment 41 in its set position of FIG. 7 and demonstrates how, by force of gravity, individual slip segment 41 would readily slide out of the tool but for the retaining member holding the slip segment 41 in the tool. Thus, when wickers 45 of individual slip segment 41 bite into pipe 26, bearing surfaces C and D are very much in effect.

When the individual slip segment pair 41 was in the running position, as shown in FIG. 6, each individual slip segment 41 was held in the tool by means of a retaining member at the upper end 58 of individual slip segment 41. In the embodiment of FIG. 6, the retaining member in member 44 is a pair of dove tail grooves 47. Individual slip segment 41 carries as its retaining member a pair of enlarged portions 48 on both edges thereof. Retaining members 48 mate with dove tail grooves 47 and prevent individual slip segment 41 from falling out of the tool when in the running position of FIG. 6. Thus, the dove tail retaining members keeps individual slip segment pair 41 in position when in the running mode of FIG. 6 but provides the slidable engagement needed when the slip segment pairs are set in the pipe as shown in FIG. 7. The same holds true for retaining members 51 on slip segments 32 and any retaining members employed on surface 34.

Figure 11:
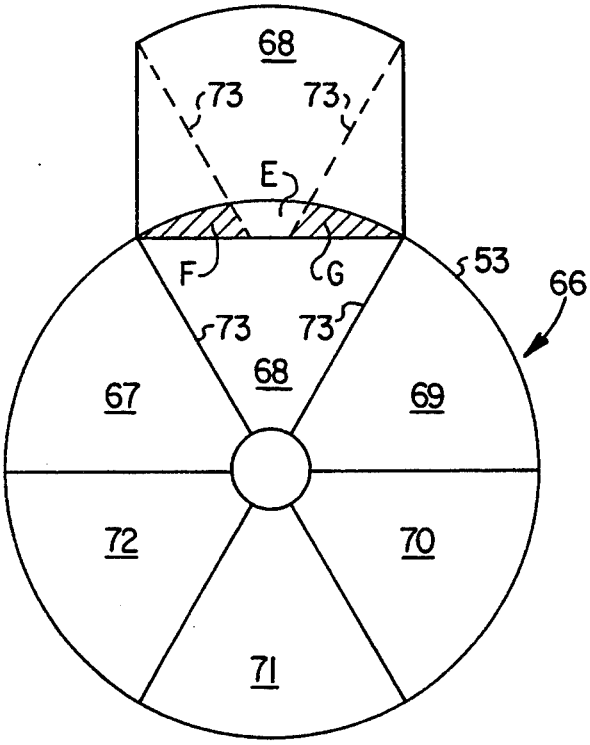
FIG. 11 demonstrates the bearing surface gain with the individual slip segments of this invention over a conventional full circle segmented slip part.

FIG. 11 demonstrates how the individual slip segments of this invention not only achieve substantially greater lateral setting distances for wellbore anchor tools, but at the same time increase the amount of bearing surface available at both ends of the individual slip segment as compared to a one piece segmented slip part. In FIG. 11, a full circle segmented slip 66 is shown to be composed of 6 unconventionally thick slip parts 67 through 72, inclusive. In practice, slip parts 67 through 72 would not be as shown in FIG. 11, but rather would be thin, as shown in FIG. 2, so they could be broken apart as shown in FIG. 3. Slip parts 67 through 72 are shown unconventionally thick, even though they are never used this way because this is the only way any support surface comparison can be achieved. Outer periphery 53 represents the outer periphery of shoe 30 as described in FIG. 8. If full circle segmented slip part 68 moved laterally to the position shown by dotted lines 73, the bearing surface overlap between part 68 and shoe 30 would be area E. In contrast, an individual slip segment of this invention would provide a bearing surface area representative of the combination of areas F and G. Thus, it can be seen that a substantial increase in bearing surface is achieved by the individual slip segment concept of this invention.

Figure 12:
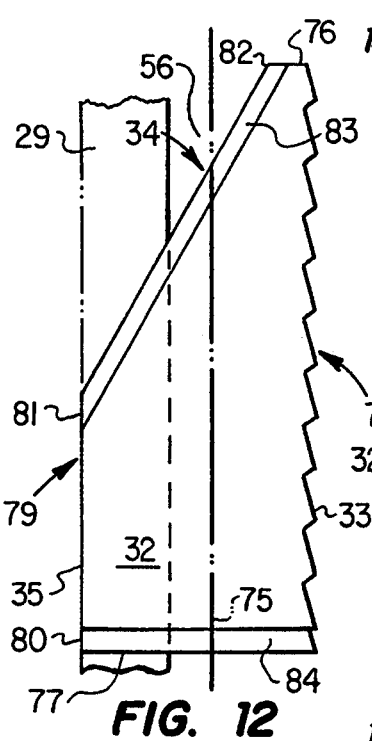
FIG. 12 shows an upstanding view of an individual slip segment within this invention.

FIG. 12 shows individual slip segment 32 of this invention to have a long axis 75 with first and second opposing ends 76 and 77 and first and second opposing sides 78 and 79. First side 78 carries slip wickers 33 while second side 79 is composed of first portion 35 and second portion 34. First side 78 extends essentially the full length of slip segment 32. Second side 79 is the side adjacent to and which wraps around mandrel 29. First portion 35 of second side 79 has first and second ends 80 and 81 and extends along long axis 75 between first and second ends 80 and 81 for a substantial length of second side 79. Second end 81 of first portion 35 is intermediate first and second ends 76 and 77 of segment 32. Second portion 34 of second side 79 is the slanted surface or sloping drive surface which extends from second end 81 of first portion 35 to a juncture point 82 in the vicinity where first side 78 and first end 76 meet. Thus, second portion 34 slopes away from mandrel 29 toward first side 78 until it meets first end 76.

Figure 13:
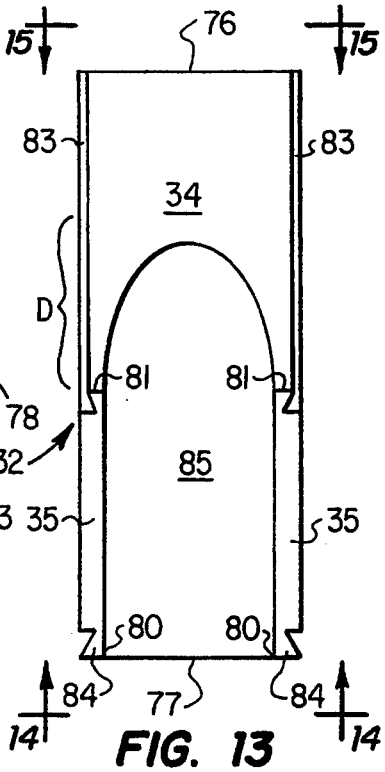
FIG. 13 shows a front view of the slip segment of FIG. 12.
Figure 14:
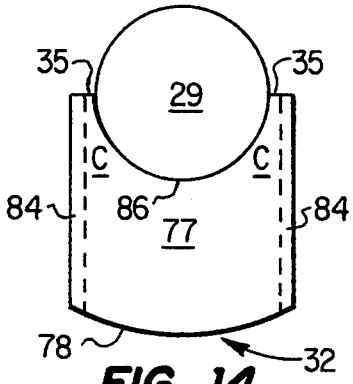
FIG. 14 shows a bottom view of the slip segment of FIG. 12.

Second side 79 defines a cavity which is better shown in FIGS. 13 and 14 that extends along long axis 75 for at least the full length of first portion 35 so that individual slip segment 32 can wrap partially around an elongate member such as mandrel 29 which extends for at least the long axis length of segment 32 and penetrates the cavity through second side 79.

Second portion 34 carries at both its edges a retaining member 83 such as the dove tail member 48 of FIG. 6. Second end 77 also carries at both its edges a retaining member 84 such as a dove tail member 48 of FIG. 6. The space between mandrel 29 and second portion 34 defines drive opening 56 for receiving a portion of a drive member such as portion 57 of drive member 36 in FIG. 9. Dove tail retaining members 83 and 84 serve to hold slip segment 32 in the tool and in slidable engagement with the tool.

FIG. 13 shows a vertical view of FIG. 12 from the direction of mandrel 29 and further shows cavity 85 in second side 79. In FIG. 13, cavity 85 extends for the full length of first portion 35 and part of the length of second portion 34. Second end 77 is shown to carry a pair of retaining members 84 at its outer edges that extend from first side 78 to second side 79. Second portion 34 similarly carries a pair of retaining members 83 at its outer edges that extend between second end 81 of first portion 35 and the juncture 82 at first end 76.

Cavity 85 can be of any desired configuration so long as it conforms with a substantial portion of the circumference of mandrel 29. If mandrel 29 is curvilinear, then cavity 85 will be of conforming curvilinearity so that mandrel 29 readily mates with cavity 85. For example, if mandrel 29 is essentially round, then cavity 85 will be essentially hemi-circular in cross section transverse to long axis 75.

FIG. 14 shows a bottom view of individual slip segment 32 of FIG. 13 when mandrel 29 is essentially round, side 86 being curvalinear to conform with the outer circumference of mandrel 29 and thereby defining cavity 85 which mandrel 29 is occupying in FIG. 14. FIG. 14 also shows bearing surface areas C when segment 32 is in its extended or set position shown in FIG. 7.

Figure 15:
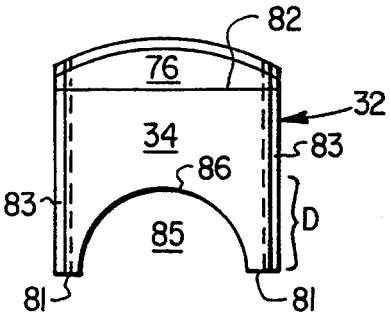
FIG. 15 shows a top view of the slip segment of FIG. 12.

FIG. 15 shows a top view of individual slip segment 32 of FIG. 12 and shows the hemi-circular cross section of cavity 85 with mandrel 29 absent from the cavity.

Figure 16:
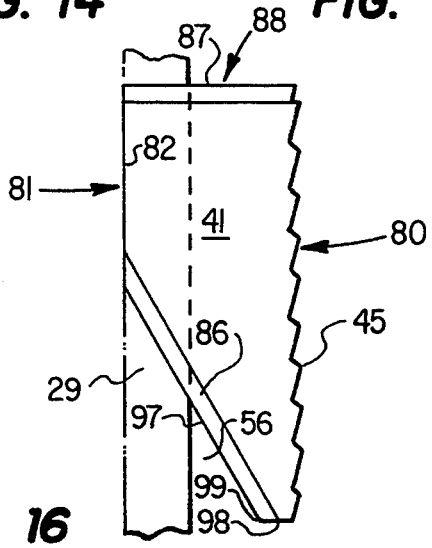
FIG. 16 shows a different orientation for the slip of FIG. 12.

FIG. 16 shows individual slip segment 41 to have first and second opposing sides 80 and 81 with second side 81 being composed of a first portion 82 and a slanted second portion 97 which meets first end 98 at juncture 99 thereby defining drive opening 56. Individual slip segment 41 carries a pair of retaining means 86 at its outer edges, just like retaining members 83 of individual slip segment 32, and another pair of retaining members 87 at the outer edges of second end 88, just like retaining members 84 of individual slip segment 32.

As shown in FIGS. 12 and 16, retaining members 83 and 87 of slip segments 32 and 41, respectively, help keep the slip segments from falling out of the tool when in the running position of FIG. 6 while all retaining members keep the individual slip segments not only in the tool but in slidable engagement with the tool so that they can be set as shown in FIG. 7.

Figure 17:
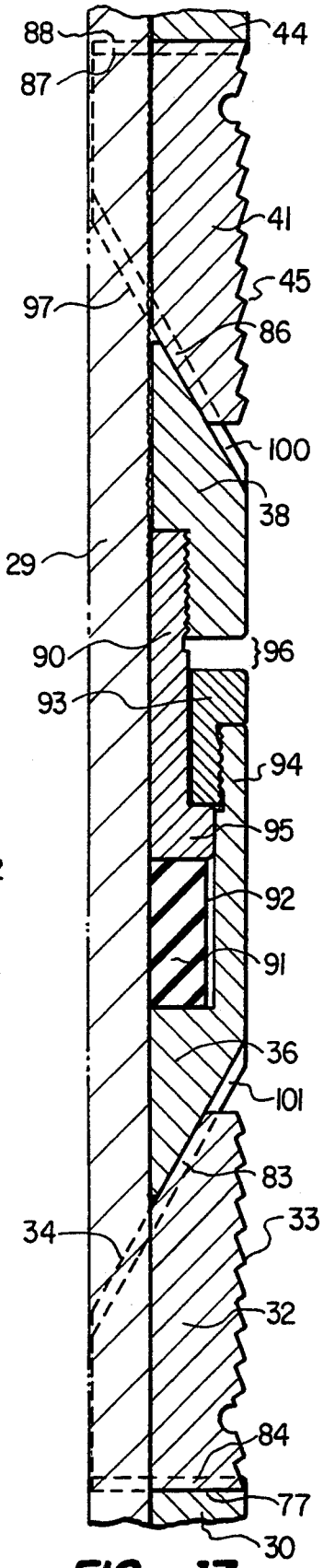
FIG. 17 shows yet another structure for a wellbore anchor tool within the scope of this invention.

FIG. 17 shows yet another embodiment of a tool within this invention wherein mandrel 29 carries spaced apart individual slip segment pairs 32 and 41 as aforesaid, each mating with frusto-conical cylindrical drive members 36 and 38. In this embodiment, retaining members 87 of individual slip segment 41 fit into dove tail grooves on member 44 the same way as shown for elements 47 and 48 of FIG. 6. Similarly, retaining members 86 of second portion 97 of individual slip segment 41 mates with a pair of dove tail grooves 100 in drive member 38 in the same manner shown for elements 47 and 48 of FIG. 6. In the same way, retaining members 84 of second end 77 of individual slip segment 32 dove tail with a pair of grooves (not shown) in shoe 30 while retaining members 83 of second portion 34 dove tail with a pair of grooves 101 in drive member 36.

Drive member 38 is fixed to sleeve 90 which fits around mandrel 29 and abuts resilient member 91. Drive member 36 encompasses outer side 92 of resilient member 91 and extends at 94 to overlap sleeve 90. A locking member 93 is fixed to extension 94 of drive member 36 and abuts shoulder 95 of sleeve 90 to physically lock sleeve 90 adjacent resilient member 91.

In operation, when drive member 38 is forced against individual slip segment pair 41, the end of sleeve 90 adjacent resilient member 91 is forced against resilient member 91 as it moves away from locking member 93. Individual slip segment 32 and drive member 36 are similarly forced together, and in so doing compressing resilient member 91 from the opposite end of sleeve 90. This operation deforms resilient member 91 so that it keeps pressure on drive members 36 and 38 to keep individual slip segment pairs 32 and 41 in their extended and locked position. At the same time, resilient member 91 is forced against mandrel 29 thereby helping to lock the overall tool in place against the mandrel as well as the well pipe. This helps keep the tool in its set position of FIG. 7 notwithstanding subsequent forces, vibrations, or the like to which the tool may be subjected during subsequent well operations.

In a preferred operation shear pins such as those shown in FIG. 5 at 37 and 39 would preferentially be sheared so that the lower pair of individual slip segments 32 would first be set before the second upper pair of individual slip segments 41 were set and the tool finally locked in place by a lock ring such as 42 of FIG. 5. For such an operation resilient member 91 is preferably a rubber member although mechanical spring configurations can be employed to obtain similar results.

Gap 96 between drive member 38 and locking member 93 is the stroke length necessary to compress resilient member 91. Generally, any setting stroke length can be used. The bearing surface for second portions 34 and 97 is preferably essentially flat, and not curved, for maximum contact bearing area when the tool is set. The tool of this invention can be carried by any commercially available setting tool which will connect with elements 31 and 44 of FIG. 5.

Reasonable variations and modifications are possible within the scope of this disclosure without departing from the spirit and scope of this invention.

What is claimed is:

1. A wellbore anchor tool having a long axis, said tool comprising a mandrel extending along said long axis for at least part of the length of said tool, at least one pair of individual slip segments, each individual slip segment having first and second opposing sides, said first side having a plurality of slip wickers thereon, said second side having a cavity therein, said cavity extending along at least part of said second side so that each individual slip segment mates with and wraps partially around said mandrel along said long axis of said tool, said pair of slip segments in combination when mated with said mandrel in opposing relationship wrapping essentially around said mandrel, each individual slip segment having on its cavity side a slanted surface which extends away from said mandrel toward said first side thereby defining a sloping drive surface on said slip segment, said slanted surface and opposing mandrel defining a drive opening which narrows as said drive surface approaches said mandrel, at least one drive member carried by said mandrel, said drive member having a sloping surface which mates with said drive surface of said slip segments so that when said drive member is forced into said drive opening said slip segments are moved transverse to said long axis, each said slip segment carrying at least one retaining member for holding said slip segment in said tool and in slidable engagement with said tool.

2. The apparatus according to claim 1 wherein said mandrel is curvilinear and said cavity is curvilinear so that said mandrel mates with said cavity.

3. The apparatus according to claim 1 wherein said mandrel carries a shoe, said slip segments are adjacent said shoe and carry at least one retaining member which cooperates with said shoe to hold said slip segments in sliding engagement with said tool.

4. The apparatus according to claim 3 wherein said sloping drive surface of each said slip segment carries at least one retaining member which cooperates with said drive member to hold said slip segments in sliding engagement with said tool.

5. The apparatus according to claim 4 wherein at least two pairs of individual slip segments are carried by said mandrel, said pairs of slip segments being spaced from one another along said long axis, and each pair of slip segments being oriented in a direction transverse to said long axis which is different from each other pair of slip segments.

6. The apparatus according to claim 1 wherein said drive member is a cone carried by said mandrel and drives one pair of slip segments, each pair of slip segments having its own cone as a drive member.

7. The apparatus according to claim 1 wherein said slip segment drive surface is essentially flat.

8. A wellbore anchor tool having a long axis, said tool comprising a curvilinear mandrel extending along said long axis for at least part of the length of said tool, at least two pair of individual slip segments, each pair of individual slip segments being carried spaced apart from adjacent pairs along said mandrel, each individual slip segment having first and second opposing sides, said first side carrying a plurality of slip wickers, said second side having a curvilinear cavity that mates with said mandrel and extends along at least part of said second side so that each individual slip segment wraps partially around said mandrel along said long axis of said tool, each said pair of slip segments when mated with said mandrel in opposing relationship in combination wrap essentially around said mandrel, each individual slip segment having on its curvilinear cavity side a slanted surface which extends away from said mandrel toward said first side thereby providing a sloping drive surface on said slip segment and defining a drive opening between said drive surface and said mandrel which gradually narrows as said drive surface approaches said mandrel, a drive member carried by said mandrel adjacent the drive openings of each said pair of slip segments, each said drive member having a pair of sloping surfaces which mate with said drive surfaces of said adjacent pair of slip segments so that when each said drive member is forced into said drive openings of each pair of slip segments said pair of slip segments are moved away from said mandrel transversely to said long axis of said tool, each said slip segment carrying at least one retaining member for holding said slip segment in said tool and in slidable engagement with said tool.

9. The apparatus according to claim 8 wherein said drive surface is essentially flat.

10. The apparatus according to claim 8 wherein said drive member is carried on said mandrel by a shear member.

11. The apparatus according to claim 10 wherein each shear member for each said drive member shears at a different load level so that said slip segment pairs are activated sequentially.

12. The apparatus according to claim 8 wherein first and second pairs of individual slip segments are employed in spaced apart fashion to define an open space between said first and second pairs, said drive openings of said first and second pairs of individual slip segments face said open space, each said drive member for said first and second pairs of individual slip segments are carried in said open space facing the drive openings for its associated pair of individual slip segments so that said drive members are adjacent one another in said open space, and at least one resilient member between said adjacent drive members so that after said individual slip segments are activated to move said segments transversely to said long axis and set said tool in place in said wellbore and locked to keep said tool set said resilient means continues to exert a force on both said drive members to keep said individual slip segments in said set position.

13. The apparatus according to claim 12 wherein said at least one resilient member additionally applies force to said mandrel after said individual slip segments are activated thereby to help keep said individual slip segments in place after activation thereof in spite of vibrations said tool may be subjected to after it is set in place in said wellbore.

14. The apparatus according to claim 12 wherein said adjacent drive members are slidably connected to one another by way of a connecting sub, and said connecting sub bears on said resilient member so that when said tool is set in said wellbore said connecting sub is forced against and compresses said resilient member and in reaction said compressed resilient member maintains said drive members forcibly in said drive openings and forcibly in contact with said mandrel.

15. The apparatus according to claim 14 wherein said drive members are each a cone that encompass and slides along said mandrel, and each cone carries a surface which mates with the drive surface of each individual slip segment of the pair of slip segments said cone drives.

16. The apparatus according to claim 15 wherein each individual slip segment carries at least two dove tail retaining members which coact with matching dove tail retaining members carried by its associated drive member.

17. The apparatus according to claim 16 wherein said mandrel carries first and second shoes adjacent said first and second pairs of individual slip segments on the opposite side of said pairs of individual slip segments from said open space, and each individual slip segment carries at least two dove tail retaining members which coact with matching dove tail retaining members carried by its associated shoe.

18. The apparatus according to claim 12 wherein a plurality of first and second pairs of individual slip segments and associated drive members are employed along a common mandrel.

19. The apparatus according to claim 8 wherein said curvilinear cavity is essentially hemi-circular in its cross section which is transverse to said long axis.

20. In an individual slip segment having a long axis, first and second opposing ends, first and second opposing sides extending between said first and second ends, said first and second sides extending along said long axis, said first side extending essentially the full length of said segment and carrying a plurality of slip wickers along at least a portion of the length thereof, the improvement comprising said second side being composed of at least a first portion and a second portion, said first portion having first and second ends and extending along said long axis from said second end of said segment for a substantial length of said second side to said second end of said first portion, said second end of said first portion being intermediate said first and second ends of said segment, said second portion slanting from said second end of said first portion to a juncture point in the vicinity where said first side and said first end of said segment meet, said second side being further characterized by a cavity that extends along said long axis for at least the full length of said first portion, said cavity extending through at least said first portion so said segment can wrap partially around an elongate member which elongate member extends for at least the long axis length of said segment and penetrates said cavity through said second side.

21. The article according to claim 20 wherein said elongate member is curvilinear and said cavity is curvilinear so that said elongate member mates with said cavity.

22. The article according to claim 20 wherein said second portion is essentially flat.

23. The article according to claim 20 wherein said second segment carries at least one retaining member for holding said segment in a tool and in slidable engagement with said tool.

24. The article according to claim 23 wherein said second end of said segment has a pair of outer edges that extend between said first and second sides and each of said second end outer edges carries a retaining member.

25. The article according to claim 23 wherein said second portion of said second side has a pair of outer edges that extend between said second end of said first portion and said juncture point and each of said second portion outer edges carries a retaining member.

26. The article according to claim 23 wherein said second end of said segment has a pair of outer edges that extend between said first and second sides, said second portion of said second side has a pair of outer edges that extend between said second end of said first portion and said juncture point, and each of said outer edges for said second end and said second portion carries a retaining member.

27. The article according to claim 23 wherein said at least one retaining member carries a dove tail groove for performing both said holding and slidable engagement functions.

28. The article according to claim 26 wherein each said retaining member carries a dove tail groove for performing both said holding and slidable engagement functions.

29. The article according to claim 20 wherein said curvilinear cavity is essentially hemi-circular in cross section transverse to said long axis.

30. The article according to claim 20 wherein said cavity extends for the full length of said first portion and part of the length of said second portion, and said cavity extends through both said first and a portion of said second portions.

* * * * *